United States Patent [19]

Bergin et al.

[11] Patent Number: 4,631,651

[45] Date of Patent: Dec. 23, 1986

[54] REPLACEABLE AUTOMOBILE HEADLIGHT LAMP UNIT AND AUTOMOBILE HEADLIGHT UTILIZING SAME

[75] Inventors: John A. Bergin, Hancock; Frank Cangiano, Hillsboro, both of N.H.

[73] Assignee: GTE Products Corporation, Stamford, Conn.

[21] Appl. No.: 743,122

[22] Filed: Jun. 10, 1985

[51] Int. Cl.[4] ..... F21V 29/00

[52] U.S. Cl. ..... 362/267; 362/61; 362/211; 339/127 C

[58] Field of Search ..... 362/257, 296, 299, 369, 362/435, 437, 436, 438, 439, 440, 443, 306, 294, 390, 441, 448; 262/61, 267; 339/127 C

[56] References Cited

U.S. PATENT DOCUMENTS 4,241,391 12/1980 Pitkjaan et al. ..... 362/306 X
4,360,861 11/1982 Fitzgerald ..... 362/211
4,427,255 1/1984 Cox ..... 362/296 X
4,502,103 2/1985 Collins ..... 362/306 X
4,528,619 7/1985 Dolan et al. ..... 362/296 X

*Primary Examiner*—Larry Jones
*Attorney, Agent, or Firm*—Lawrence R. Fraley

[57] ABSTRACT

A replaceable automobile headlight lamp unit and headlight utilizing same wherein the unit's electric lamp (e.g., tungsten halogen) is securedly retained within a clamp member including an insulative base and a pair of spaced-apart retaining clips for grasping the lamp's press-sealed end portion. The base includes a curvilinear surface which mates with a surface having a similar configuration located within an insulative holder which also forms part of the invention. A pair of spaced contacts located within the holder pass through apertures within the base and are connected (e.g., welded) to the retention clips. A ball-joint arrangement is thus provided to enable facile alignment of the electric lamp relative to the holder prior to final securement between the holder and base components.

18 Claims, 2 Drawing Figures

REPLACEABLE AUTOMOBILE HEADLIGHT LAMP UNIT AND AUTOMOBILE HEADLIGHT UTILIZING SAME

CROSS REFERENCE TO COPENDING APPLICATIONS

In Ser. No. 507,389, filed June 24, 1983 and entitled "Replaceable Lamp Unit Providing Hermetic Seal And Fixed Alignment For Electric Lamp Contained Therein And Automobile Headlight Utilizing Same" (inventors: R. J. Dolan et al), there is described an automobile headlight and replaceable lamp unit for use therein wherein the unit's insulative holder includes conical-shaped apertures having similarly shaped eyelets secured therein and at least two conductive lug members mechanically connected (e.g., by crimping) to the eyelets to seal the eyelets and provide positive electrical connection thereto. Ser. No. 507,389 is now U.S. Pat. No. 4,528,619, having issued July 9, 1985.

In Ser. No. 691,803, filed Jan. 15, 1985 and entitled "Replaceable Automobile Headlight Lamp Unit" (inventors: J. R. Van der Linde et al), there is described a replaceable lamp unit wherein the unit's lamp has a clamp secured thereto which includes a plurality of flange segments thereon. These segments align with and are secured to a slotted insert which is securedly retained within the unit's insulative holder.

In Ser. No. 691,804, filed Jan. 15, 1985 and entitled "Replaceable Lamp Unit And Automobile Headlight Utilizing Same" (inventors: J. A. Bergin et al), there is described a replaceable lamp unit having a clamp secured to the lamp's base and including curved flange portions which can be rotatably aligned on similarly curved outer surfaces of an insert member and welded thereto. The insert is securedly retained within the unit's holder. Ser. No. 691,804 is now U.S. Pat. No. 4,569,005, having issued Feb. 4, 1986.

In Ser. No. 691,806 filed Jan. 15, 1985 and entitled "Replaceable Lamp Unit And Automobile Headlight Utilizing Same" (inventors: B. Warren et al), there is described a replaceable lamp unit wherein a clamp, secured to the lamp's sealed end, is frictionally inserted within the unit's insert member and thereafter secured (e.g., welded) thereto. The insert member is only partly inserted within the unit's holder to enable the aforementioned securement to be accomplished externally of the holder. Ser. No. 691,806 is now U.S. Pat. No. 4,569,006, having issued Feb. 4, 1986.

In addition to the above, in Ser. No. 507,393, filed June 24, 1983 and entitled "Method Of Making Replaceable Lamp Unit For Automotive Headlight," there is described a method of making a replaceable lamp unit wherein conductive members are mechanically connected to respective lug members by drawing these conductive members through apertures within the unit's plastic holder. Support wires, which are joined to the lamp's lead-in wires, are also used and are fixedly positioned within the conductive member after the aforementioned mechanical connection. Ser. No. 507,393 is now U.S. Pat. No. 4,507,712, having issued Mar. 26, 1985.

All of the above-identified Applications are assigned to the same assignee as the instant invention.

TECHNICAL FIELD

The invention relates to automobile headlights and more particularly to those wherein a replaceable lamp unit assembly is utilized (such as those described above).

BACKGROUND

Automobile headlights wherein a replaceable lamp unit is employed are known. Examples are illustrated in the below-identified patents:

U.S. Pat. No. 2,423,664 by E. RYDER
U.S. Pat. No. 2,750,491 by H. J. ANDERSON
U.S. Pat. No. 3,593,017 by P. CIBIE
U.S. Pat. No. 3,688,103 by H. DAUMULLER
U.S. Pat. No. 3,917,939 by H. J. SCHMIDT ET AL
U.S. Pat. No. 3,987,326 by G. LINDAE
U.S. Pat. No. 4,342,142 by Y. NEIDA ET AL
U.S. Pat. No. 4,344,119 by T. BERGOT
U.S. Pat. No. 4,412,273 by P. HELBIG ET AL

As stated, the instant invention is related to lamp units of the variety described above. In particular, the invention defines a replaceable lamp unit which provides both a hermetic seal for the unit within the headlight's reflector and, equally important, assures that the electric lamp utilized therewith will be maintained in strict alignment as is necessary in automotive headlights. By the term "hermetic seal" is meant a seal which prevents the passage of moisture, dust and other elements which can adversely affect the operation of the headlight. By way of example, excessive moisture entering the headlight can adversely affect the reflective coating typically utilized on the concave reflector of the headlight, and thus significantly reduce light output therefrom.

In addition to providing a hermetic seal, the replaceable lamp unit defined herein assures that alignment of the electric lamp employed therewith will be maintained. That is, alignment of the glass envelope of the lamp relative to the unit's holder is provided such that the filament structure within the envelope (typically either a singular coiled filament or two, spaced coiled filaments) will be accurately aligned relative to the optical axis of the headlight's reflector when the lamp unit is oriented within the reflector's rear opening. Such alignment is deemed critical to assure optimum headlight output in the direction(s) desired.

As also described herein, a preferred light source which constitutes an important part of the replaceable lamp unit defined herein is an electric lamp of the tungsten halogen variety. One example is shown in U.S. Pat. No. 3,829,719 (Westlund, Jr. et al), this patent assigned to the same assignee as the instant invention. In tungsten halogen lamps, the tungsten which constitutes the filament material is normally evaporated from the filament during lamp operation and combines with the halogen to form a gaseous halide, the halide preventing the tungsten from depositing on the internal wall of the lamp's glass envelope. Upon returning to the filament structure, the halide decomposes, resulting in the deposition of tungsten back onto the filament structure and the release of additional halogen gas to assure continuation of the cycle. The halogen cycle is well known in the art and lamps employing it have been used for some time. Several varieties are presently manufactured and sold by the assignee of the invention. In the case of the two beam (dual filament) lamp, a typical tungsten halogen lamp provides about 65 watts when operated at high beam and about 45 watts at low beam. As stated, it is critical that the filament structure of the lamp within an automobile headlight be precisely aligned relative to the reflector to provide optimum output of the finished headlight. As will be described below, such alignment constitutes an important feature of the replaceable lamp unit defined herein.

DISCLOSURE OF THE INVENTION

It is an object of the instant invention to enhance the automobile headlight art and, more particularly, to enhance that portion of the art wherein replaceable units that employ electric lamps are utilized.

It is another object of the invention to provide a replaceable lamp unit for use within an automobile headlight which provides a hermetic seal within the headlight's reflector and also maintains the lamp in a fixed, precisioned relationship relative to the holder thereof such that the lamp is precisely oriented relative to the headlight's reflector when the unit is located therein.

It is an even further object of this invention to provide an automobile headlight wherein a replaceable lamp unit is utilized and wherein such a unit is hermetically sealed within a rear opening of the headlight's reflector in such a manner that the unit's electric lamp is precisely oriented relative to the headlight's reflector.

It is yet another object of the invention to provide such a replaceable lamp unit and automobile headlight which can be inexpensively produced in a manner readily adapted to mass production.

In accordance with one aspect of the invention, there is defined a lamp unit for being removably positioned within a rear opening of a headlight reflector, the unit comprising an electrically insulative holder for being positioned within the opening, the holder defining a cavity therein having at least one curved surface, an electric lamp adapted for being securedly retained in a predetermined orientation relative to the holder, the lamp including an envelope having a filament structure therein adapted for being positioned within the reflector when the holder is positioned within the opening of the reflector and at least two lead-in wires projecting from the envelope, and a clamp member including an electrically insulative base positioned within the cavity of the holder and fixedly secured thereto and a pair of electrically conductive clips spacedly positioned within the base and secured about the envelope of the lamp. Each of the lead-in wires is connected to a respective one of the clips at a precise location relative to the filament structure. The base includes at least one external surface of a curvature substantially similar to the curved surface of the cavity for engaging the curved surface whereby the base can be rotatably oriented within the cavity of the holder prior to fixed securement thereto.

In accordance with another aspect of the invention, there is defined an automobile headlight comprising a reflector having an opening within a rear portion thereof, a front lens secured to or forming part of the reflector for directing light in a predetermined manner, and a lamp unit for being removably positioned within the opening within the rear portion of the reflector. The lamp unit includes an electrically insulative holder for being positioned within the opening, the holder defining a cavity therein having at least one curved surface, an electric lamp adapted for being securedly retained in a predetermined orientation relative to the holder, the lamp including an envelope having a filament structure therein adapted for being positioned within the reflector when the holder is positioned within the opening of the reflector, and a clamp member including an electrically insulative base positioned within the cavity of the holder and fixedly secured thereto and a pair of electrically conductive clips spacedly positioned within the base and secured about the envelope of the lamp. Each of the lead-in wires is connected to a respective one of the clips at a precise location relative to the filament structure. The base includes at least one external surface of a curvature substantially similar to the curved surface of the cavity for engaging the curved surface whereby the base can be rotatably oriented within the cavity of the holder prior to fixed securement thereto.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 2:
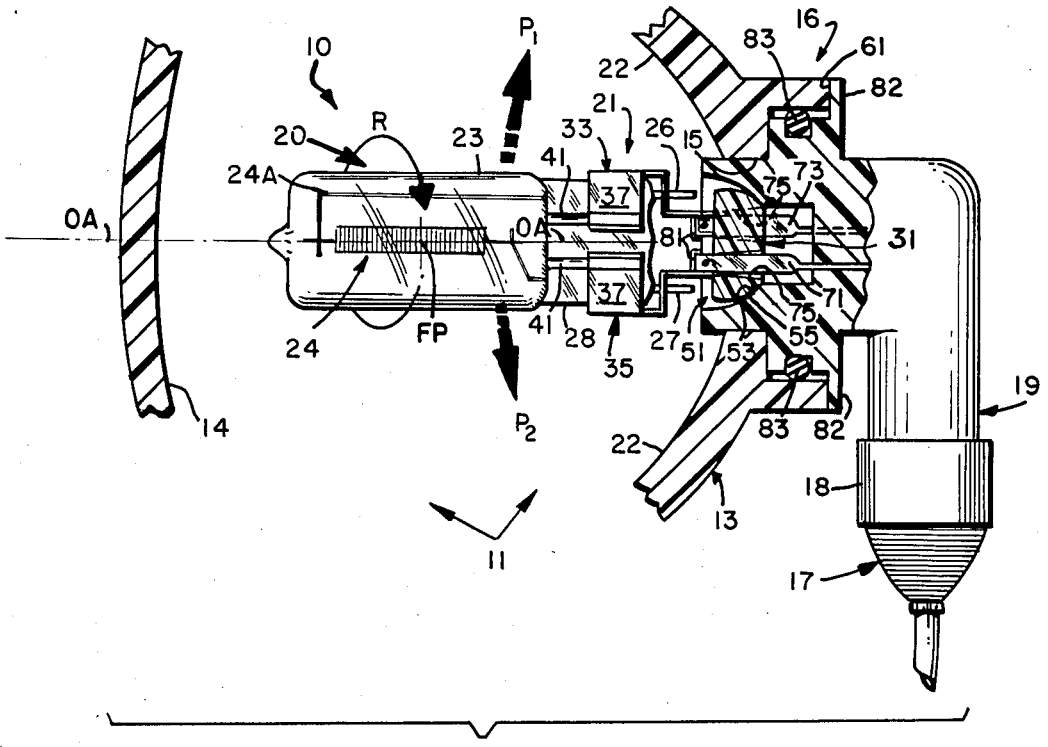
FIG. 2 is a side elevational view, in section of the lamp unit of the invention and further illustrating the reflector and lens members of a preferred embodiment of an automobile headlight of the invention.

With particular attention to the drawings, there is illustrated a lamp unit 10 in accordance with a preferred embodiment of the invention. In FIG. 2. lamp unit 10 is shown in position within an automobile headlight 11 which includes a reflector 13 and a front lens member 14 which is secured to the front of or forming part of the reflector. Both reflector and lens components may be of plastic or glass material or, alternatively, a combination thereof.

Lamp unit 10 is designed for being removably positioned within an opening 15 located within the rear, apex portion 16 of reflector 13. Apex portion 16 is also shown as including a thickened boss portion which projects externally from the rear surfaces of the curvilinear (e.g., paraboloidal) reflector. When in position, lamp unit 10 is designed for being electrically connected to an external connector 17 which consitutes part of the electrical system of the automobile utilizing headlight 11. More particularly, external connector 17 is designed for being inserted within the rear portion 18 of the insulative holder 19 which forms part of unit 10. Such a connector typically includes a plurality of electrical wires which also form part of the automobile's electrical circuit. Connector 17 is thus either directly or indirectly connected to the power source (e.g., 6- or 12-volt battery) typically found in most of today's automobiles or other motor vehicles.

Lamp unit 10 includes the aforementioned electrically insulative holder 19, an electric lamp 20, and a clamp member 21 which is designed for retaining lamp 20 therein and for being securedly positioned within holder 19. When so assembled, lamp unit 10 is then capable of being positioned within rear opening 15 of reflector 13 such that the lamp extends within and is substantially surrounded by the internal reflective surfaces 22 of the reflector.

The preferred electric lamp for use in the instant invention is of the tungsten halogen variety and includes a glass envelope 23 having located therein a coiled tungsten filament 24. Lamp 20 is oriented within reflector 13 such that filament 24 is substantially centered at the focal point (FP in FIG. 2) of the reflector. It is also preferred that the longitudinal filament body lie along the optical axis OA—OA of the reflector in the manner depicted in FIG. 2.

Filament 24 is preferably of coiled coil construction and includes the illustrated parallel support rod 24A lying alongside the filament's main body portion. It is also within the scope of the invention to utilize other types of filament configurations, including those which lie orthogonal to the reflector's optical axis. As also shown in the drawings, lamp 20 includes only a singular filament 24 within envelope 23. It is also within the scope of the invention to utilize a double filament structure wherein two spaced apart coiled filaments are utilized. In the singular filament construction shown herein, lamp 20 further includes a pair of electrically conductive lead-in wires 26 and 27 which project externally from the envelope's press-sealed, flattened end portion 28. In the event that a dual filament structure is utilized, a total of four lead-in wires would project externally from sealed end 28. It is thus understood with regard to the instant invention, that holder 19 is adapted for accommodating both single and double coiled filament lamps of the type described herein.

Figure 1:
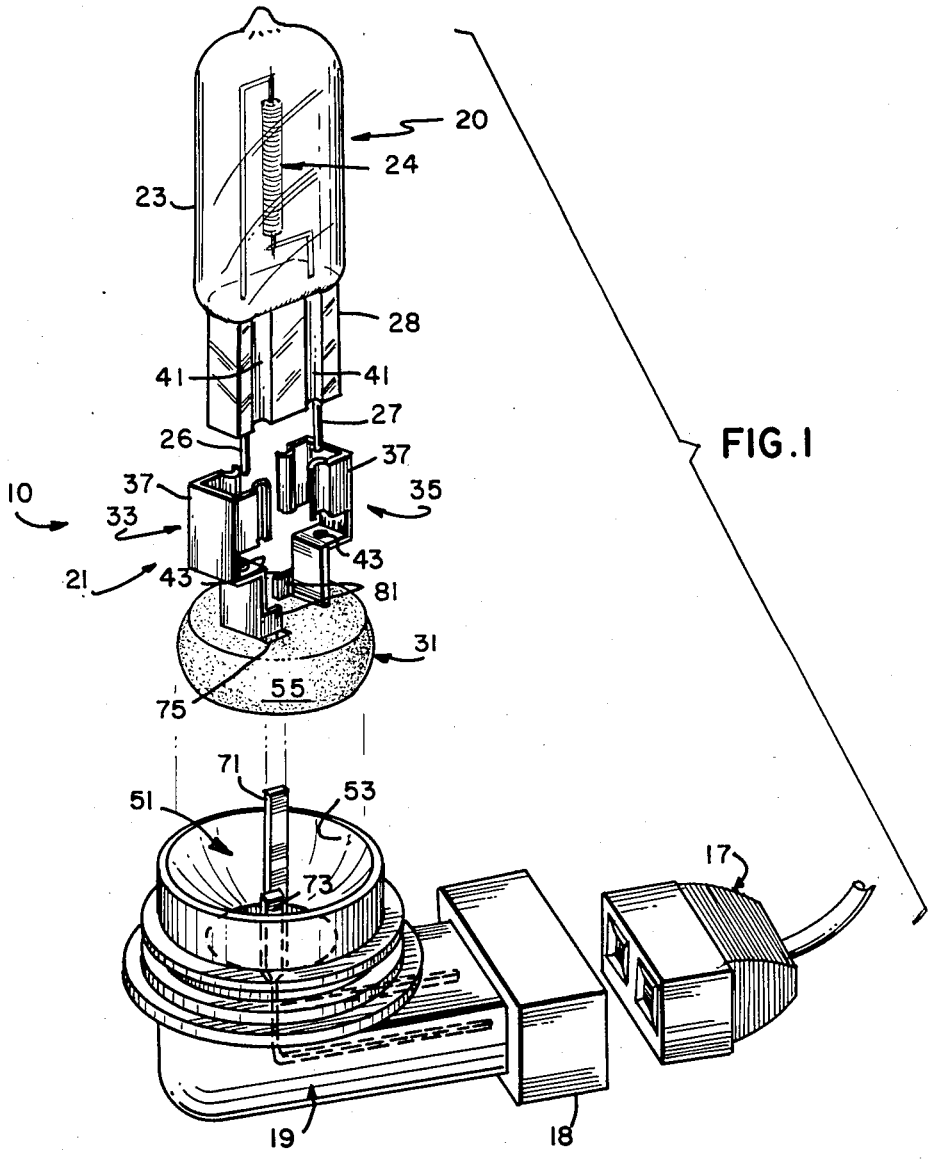
FIG. 1 is an exploded perspective view of the electric lamp, insulative holder, and clamp member of the invention in accordance with a preferred embodiment thereof.

Clamp member 21 includes an electrically insulative (e.g., plastic) base 31 which includes therein a pair of electrically conductive clips 33 and 35. Clips 33 and 35 are spacedly positioned within base 31 and are firmly secured within the base during molding thereof. Each clip includes an upper clamping section 37 which is designed for being secured about a respective side of the flattened end portion 28 of envelope 23. As shown in FIG. 1, each clip is of a substantially U-shaped configuration when viewed from the top and includes a pair of opposed expandable sides for grasping the respective side on opposite sides thereof. To facilitate this securement, these grasping sides can include curvilinear end portions (as shown) designed for fitting within corresponding grooves or slots 41 formed within end 28.

Clips 33 and 35 are secured about end 28 such that each of the projecting lead-in wirse 26 and 27 respectively pass through corresponding openings 43 located within each clip. As best shown in FIG. 2, each lead-in wire penetrates a respective opening to a predetermined depth whereupon it is secured (e.g., welded) to the clip at this location. It is thus possible using the teachings of the instant invention to precisely orient lamp 20 at a predetermined location relative to the stationary clips which form part of clamp member 21. This is deemed an important feature of the invention with regard to proper alignment of lamp 20 within reflector 13, as will be further understood from the following description. As stated, alignment of the invention's lamp within the illustrated reflector is deemed critical such that optimum light output from headlight 11 can be attained. The aforementioned securement and connection of lead-in wires 26 and 27 relative to clips 33 and 35 to thus assure a precisioned depth of lamp 20 (and particularly the centrally disposed filament structure 24) constitutes but one of the directions in which lamp 20 is aligned.

With lamp 20 in position and fixedly secured to clamp 21, the insulative base 31 is then located within a cavity 51 defined within holder 19 and including at least one curved surface 53. As best shown in FIG. 1, this curved surface extends substantially about the entire upper portion of cavity 51 and opens in a direction toward lamp 20. For purposes of the invention, it is preferred that curved surface 53 be of semi-spherical configuration, although it is understood that other configurations are within the scope of the invention. Accordingly, base 31 includes an external surface 55 of similar configuration to that of surface 53. When fully inserted within cavity 51, base 31 and holder 19 thus form a ball-joint type of connection. This unique positioning relationship enables preliminary pivotal movement (i.e., in directions $P_1$ and $P_2$ in FIG. 2) to define yet another means of aligning filament structure 24. With the base fully inserted, such movement, including that toward and away from the viewer in FIG. 2, can be accomlished (e.g., by suitable mechanical means) in order to attain precision orientation of the filament structure relative to surface 53 within holder 19. Because this curved surface corresponds to (is located at a fixed distance from) another surface (i.e., 61) which mates against a corresponding external surface of reflector 13, it is thus possible to assure a precise location of the lamp's filament relative to reflective surfaces 22. It is also understood, of course, that all of the aforedefined positioning of lamp 20 relative to holder 19 is preferably accomplished externally of reflector 13.

As shown in the drawings, holder 19 further includes therein a pair of spaced electrical contacts 71 and 73 molded therein and each having a flattened blade portion extending within cavity 51. As also shown in FIG. 1, each contact has an opposing end portion which extends within the opposing end 18 of holder 19 and is designed for making contact with respective contacts within connector 17. To even further facilitate positioning of base 31 within cavity 51, a pair of spaced apertures 75 are provided within the base. Accordingly, each flattened blade portion of contacts 71 and 73 is designed for being inserted within and passing through a respective one of the similarly configured apertures (only one shown in FIG. 1). When fully inserted, each contact is designed for being secured (e.g., welded) to a respective tab 81 which projects from and forms part of a respective one of the invention's electrically conductive clips. Prior to such securement, however, the aforementioned rotational or pivotal movement of the lamp is accomplished. It is understood that base 31 is firmly seated within the similarly shaped cavity 51 at this time. To facilitate such pivotal motion, each contact is tapered from the wider, flattened blade portion of substantially rectangular configuration as shown to a much narrowr portion at the approximate point of exit by the contact from the main body portion of holder 19. This tapered configuration is best illustrated in FIG. 2. To even further facilitate the aforedescribed pivotal movement of lamp 20, each of the described apertures 75 within base 31 is also of substantially tapered configuration. As shown in FIG. 2, each aperture is tapered such that the end possessing the larger opening is located at the location of initial entry by the invention's electrical contacts 71 and 73. It is thus understood from the foregoing description that the lamp 20 can be moved not only in the described pivotal manner (i.e., $P_1$ and $P_2$) but also in a rotational manner (i.e., R in FIG. 2).

After all of the foregoing orientations are achieved, base 31 is secured to holder 19 using RF induction heating. That is, base 31 is heated to the point that softening of the inner walls of the holder occurs with the material thereof thereafter permanently adhering to the base.

One important feature of the invention is that not only has extremely accurate alignment been achieved in a highly expeditious manner, but such alignment is achieved without the need for cement or the like as has often been required in lamp technology of this kind. Curing time for such material would add appreciably to the overall assembly cost of such a unit. In addition, cements of this variety typically outgas at elevated temperatures, such gas possibly adversely affecting the finished product (e.g., by affecting the internal reflective surfaces of the headlight's reflector). The lamp unit of the instant invention overcomes both of these deleterious effects.

Securement of holder 19 within rear opening 15 is preferably accomplished in one of two ways. It is within the scope of the invention to provide internal screw threads or the like (not shown) within the internal walls of opening 15 and corresponding male threads on the external surface of holder 19 whereupon the holder can simply be screwed within opening 15. In a second and more preferred arrangement, it is possible to utilize a removable cap member (not shown) which is adapted for being positioned on an external surface of the neck portion of reflector 13 (e.g., by providing external grooves or slots therein) with the cap member being retained thereon in a locking arrangement. Portions of the cap would in turn engage the external flange portions (i.e., 82 in FIG. 2) to retain the holder against the reflector's neck portion as depicted in FIG. 2. Other means of retention are also possible and thus within the scope of the instant invention as defined herein. Further definition is thus not believed necessary.

To further assure a sound hermetic seal between the exterior surfaces of holder 19 and the internal surfaces of reflector 13, a silicone O-ring 83 (FIG. 2) is provided. O-ring 83 is located within a corresponding groove or slot within the holder's external surface and projects slightly thereabove to provide a compression fit between the O-ring and reflector.

Thus there has been shown and described a replaceable lamp unit for use within an automobile headlight wherein the unit provides a hermetic seal between the electric lamp's holder and reflector, in addition to an effective means of precisely aligning the lamp in fixed relationship to the holder such that it in turn will be precisely aligned within the headlight's reflector. As shown in FIG. 2, the automobile headlight 11 capable of using lamp unit 10 includes not only the defined concave reflector 13 but also a corresponding front lens member 14 which, as is known in the art, directs light therethrough in a predetermined manner. The preferred material for reflector 13, lens 14, holder 19 and base 31 is a polycarbonate plastic. The electrical contacts 71 and 73 and the conductive retaining clips 33 and 35 are of a sound electrically conductive and weldable material. In one example, tin-plated brass was successfully utilized.

While there have been shown and described what are at present considered the preferred embodiments of the invention, it will be obvious to those skilled in the art that various changes and modifications may be made therein without departing from the scope of the invention as defined by and appended claims.

What is claimed is:

1. A lamp unit for being removably positioned within an opening within the rear of an automobile headlight reflector, said lamp unit comprising:

an electrically insulative holder for being positioned within said opening, said holder defining a cavity therein having at least one curved surface;

an electric lamp adapted for being securedly retained in a predetermined orientation relative to said holder, said lamp including an envelope having a filament structure therein adapted for being positioned within said reflector when said holder is positioned within said opening of said reflector and at least two lead-in wires projecting from said envelope; and a clamp member including an electrically insulative base positioned within said cavity of said holder and fixedly secured thereto, and a pair of electrically conductive clips spacedly positioned within said base and secured about said envelope of said lamp, each of said lead-in wires being connected to a respective one of said clips at a precise depth location relative to said filament structure, said base including at least one external surface of a curvature substantially similar to said curved surface of said cavity of said holder and engaging said curved surface, said base and cavity orientation enabling said electric lamp to be both rotatably and pivotally oriented within said cavity of said holder prior to said fixed securement of said base to said holder to precisely position said filament structure within said lamp envelope relative to a surface of said holder.

2. The lamp unit according to claim 1 wherein said envelope of said electric lamp includes a flattened sealed end portion, said clips engaging said end portion on opposite sides thereof.

3. The lamp unit according to claim 1 wherein each of said clips includes an opening therein, each of said lead-in wires being positioned within a respective one of said openings.

4. The lamp unit according to claim 1 wherein said electric lamp is a tungsten halogen lamp.

5. The lamp unit according to claim 1 further including at least two electrical contacts each located within said holder and electrically connected to a respective one of said clips.

6. The lamp unit according to claim 5 wherein said base includes at least two apertures therein, each of said electrical contacts passing through a respective one of said apertures.

7. The lamp unit according to claim 6 wherein each of said apertures is of a tapered configuration.

8. The lamp unit according to claim 6 wherein each of said contacts is of a tapered configuration having a narrow portion thereof positioned within said cavity and a wider portion extending therefrom, said wider portions being connected to said clips.

9. An automobile headlight comprising:

a reflector having an opening within a rear portion thereof;

a front lens secured to or forming part of said reflector for directing light in a predetermined manner;

a lamp unit for being removably positioned within said opening within said rear portion of said reflector, said lamp unit including an electrically insulative holder for being positioned within said opening, said holder defining a cavity therein having at least one curved surface, an electric lamp adapted for being securedly retained in a predetermined orientation relative to said holder, said lamp including an envelope having a filament structure therein adapted for being positioned within said reflector when said holder is positioned within said opening of said reflector, and a clamp member including an electrically insulative base positioned within said cavity of said holder and fixedly secured thereto and a pair of electrically conductive clips spacedly positioned within said base and secured about said envelope of said lamp, each of said lead-in wires being connected to a respective one of said clips at a precise depth location relative to said filament structure, said base including at least one external surface of a curvature substantially similar to said curved surface of said cavity of said holder and engaging said curved surface, said base and cavity orientation enabling said electric lamp to be both rotatably and pivotally orientated within said cavity of said holder prior to said fixed securement of said base to said holder to precisely position said filament structure within said lamp envelope relative to a surface of said holder.

10. The headlight according to claim 9 wherein said envelope of said electric lamp includes a flattened sealed end portion, said clips engaging said end portion on opposite sides thereof.

11. The headlight according to claim 9 wherein each of said clips includes an opening therein, each of said lead-in wires being positioned within a respective one of said openings.

12. The headlight according to claim 9 wherein said electric lamp is a tungsten halogen lamp.

13. The headlight according to claim 9 further including at least two electrical contacts each located within said holder and electrically connected to a respective one of said clips.

14. The headlight according to claim 13 wherein said base includes at least two apertures therein, each of said electrical contacts passing through a respective one of said apertures.

15. The headlight according to claim 14 wherein each of said apertures is of a tapered configuration.

16. The headlight according to claim 14 wherein each of said contacts is of a tapered configuration having a narrow portion thereof positioned within said cavity and a wider portion extending therefrom, said wider portions being connected to said clips.

17. The headlight according to claim 9 wherein said reflector is comprised of plastic material.

18. The headlight according to claim 9 wherein said pivotal positioning of said electric lamp is accomplished externally of said reflector.

* * * * *